US011155427B2

(12) United States Patent
Triepel et al.

(10) Patent No.: US 11,155,427 B2
(45) Date of Patent: Oct. 26, 2021

(54) DEVICE FOR THE SURFACE TREATMENT OF A SUBSTRATE, COMPRISING A METALLIC CONVEYOR BELT

(71) Applicant: LEONHARD KURZ Stiftung & Co. KG, Furth (DE)

(72) Inventors: Michael Triepel, Furth (DE); Konstantin Kosalla, Nuremberg (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 64 days.

(21) Appl. No.: 16/301,265

(22) PCT Filed: Apr. 6, 2017

(86) PCT No.: PCT/EP2017/058291
§ 371 (c)(1),
(2) Date: Nov. 13, 2018

(87) PCT Pub. No.: WO2017/198390
PCT Pub. Date: Nov. 23, 2017

(65) Prior Publication Data

US 2019/0210823 A1 Jul. 11, 2019

(30) Foreign Application Priority Data

May 17, 2016 (DE) ..... 102016109044.1

(51) Int. Cl.
*B65H 5/22* (2006.01)
*B41F 19/06* (2006.01)
(Continued)

(52) U.S. Cl.
CPC ..... *B65H 5/224* (2013.01); *B05D 1/28* (2013.01); *B05D 3/142* (2013.01); *B41F 16/002* (2013.01); *B41F 16/0026* (2013.01); *B41F 19/062* (2013.01); *B41F 23/00* (2013.01); *B65H 5/021* (2013.01); *H01T 19/00* (2013.01); *B05D 3/0493* (2013.01); *B05D 2252/02* (2013.01);
(Continued)

(58) Field of Classification Search
CPC ..... H01T 19/00; B05D 3/144; B65H 5/00; B65H 11/005; C01B 13/115; C01B 2201/22; C01B 2201/62
See application file for complete search history.

(56) References Cited

U.S. PATENT DOCUMENTS 4,451,497 A 5/1984 Dolezalek et al.
5,397,413 A 3/1995 Trimble et al.
(Continued)

FOREIGN PATENT DOCUMENTS

CN 1900408 1/2007
CN 1900408 A 1/2007
(Continued)

*Primary Examiner* — David E Smith
*Assistant Examiner* — Hsien C Tsai
(74) *Attorney, Agent, or Firm* — Hoffmann & Baron, LLP

(57) ABSTRACT

A device for the surface treatment of a substrate including a transport device, a vacuum suction device, a corona device and a coating device, is described. The transport device is formed as a conveyor belt. The conveyor belt is formed as a vacuum suction belt of the vacuum suction device, and the conveyor belt is formed as a counter electrode of the corona device.

30 Claims, 5 Drawing Sheets

(51) Int. Cl.

| | |
|---|---|
| ***B41F 23/00*** | (2006.01) |
| ***B65H 5/02*** | (2006.01) |
| ***B05D 3/14*** | (2006.01) |
| ***B05D 1/28*** | (2006.01) |
| ***B41F 16/00*** | (2006.01) |
| ***H01T 19/00*** | (2006.01) |
| *B05D 3/04* | (2006.01) |

(52) U.S. Cl.
CPC .... *B65H 2404/264* (2013.01); *B65H 2404/27* (2013.01); *B65H 2404/28* (2013.01); *B65H 2406/32* (2013.01)

(56) References Cited

U.S. PATENT DOCUMENTS

| | | | | |
|---|---|---|---|---|
| 5,634,185 | A | 5/1997 | Lindblad et al. | |
| 5,651,313 | A | 7/1997 | Kowaleswski et al. | |
| 5,895,738 | A | 4/1999 | Parker et al. | |
| 2003/0038420 | A1* | 2/2003 | Cleary | B65H 11/005 271/197 |
| 2004/0245712 | A1 | 12/2004 | Hesterman | |
| 2006/0055734 | A1 | 3/2006 | Kadomatsu et al. | |
| 2009/0277590 | A1 | 11/2009 | Jung et al. | |
| 2010/0112235 | A1* | 5/2010 | Prinz | C23C 16/50 427/569 |
| 2011/0252899 | A1* | 10/2011 | Felts | G01N 15/082 73/865.8 |
| 2013/0113869 | A1 | 5/2013 | Kobayashi et al. | |
| 2014/0320575 | A1 | 10/2014 | Kuypers | |
| 2015/0298491 | A1* | 10/2015 | Triepel | B44B 5/028 156/535 |
| 2016/0056615 | A1* | 2/2016 | Gydesen | B05D 3/144 427/535 |

FOREIGN PATENT DOCUMENTS

| | | | | |
|---|---|---|---|---|
| CN | 101171131 | | 4/2008 | |
| CN | 101171131 | A | 4/2008 | |
| CN | 203390404 | U | 1/2014 | |
| DE | 2714473 | | 10/1977 | |
| DE | 3134615 | | 3/1983 | |
| DE | 69303711 | T2 | 2/1997 | |
| DE | 69715327 | T2 | 1/2003 | |
| DE | 10159661 | C1 | 2/2003 | |
| DE | 69815459 | T2 | 1/2004 | |
| DE | 10232255 | A1 | 2/2004 | |
| DE | 102006019792 | A1 | 11/2006 | |
| DE | 102012110149 | A1 | 4/2014 | |
| EP | 1464491 | A2 | 10/2004 | |
| EP | 1757450 | A1 * | 2/2007 | |
| EP | 1757450 | A2 * | 2/2007 | |
| EP | 1757450 | A2 * | 2/2007 | B65H 5/00 |
| EP | 2918529 | A2 | 9/2015 | |
| GB | 1577375 | | 10/1980 | |
| JP | 2003168593 | | 6/2003 | |
| JP | 2003168593 | A | 6/2003 | |
| JP | 2006076202 | | 3/2006 | |
| JP | 2006076202 | A | 3/2006 | |
| JP | 2006290624 | | 10/2006 | |
| JP | 2006290624 | A | 10/2006 | |
| JP | 2015199325 | | 11/2015 | |
| JP | 2015199325 | A | 11/2015 | |
| WO | 2014/146669 | A1 | 9/2014 | |

* cited by examiner

DEVICE FOR THE SURFACE TREATMENT OF A SUBSTRATE, COMPRISING A METALLIC CONVEYOR BELT

This application claims priority based on an International Application filed under the Patent Cooperation Treaty, PCT/EP2017/058291, filed Apr. 6, 2017, which claims priority to DE102016109044.1, filed May 17, 2016.

The invention relates to a device for the surface treatment of a substrate according to the preamble relating to the subject-matter of claim 1.

Devices for the surface treatment of a substrate are used, for example, to print on the surfaces of curved or web-type substrates or to coat them with a transfer layer of a stamping film.

A hot-stamping device of the type described is known from DE 10159661 C1.

SUMMARY OF THE INVENTION

The object of the present invention is to specify an improved device for the surface treatment of a substrate.

According to the invention this object is achieved with the subject-matter of claim 1. A device for the surface treatment of a substrate, having a transport device, a vacuum suction device, a corona device and a coating device is proposed, wherein it is provided that the transport device has a conveyor belt, that the conveyor belt is formed as a vacuum suction belt of the vacuum suction device, and that the conveyor belt is formed as a counter electrode of the corona device.

The device according to the invention has the advantage that the transport device has a conveyor belt which fulfills three functions, namely the transport of the substrate, the positional fixing of the substrate on the conveyor belt by vacuum suction and the provision of an electrode for the corona device. The conveyor belt can fulfill these three functions in particular simultaneously, with the result that a very advantageous synergy between these functions arises.

It can be provided that the conveyor belt is mounted on two guide rollers spaced apart from each other, wherein one of the guide rollers is formed as a drive roller.

The conveyor belt can be formed as a rotating belt which rotates in particular around the two guide rollers.

Further it can be provided that the conveyor belt is mounted on a supporting device in the area of the coating device and/or of the corona device. Several supporting devices can be provided, which are arranged, for example, in the area of the coating device and of the corona device.

The supporting device can have one supporting roller or several supporting rollers which are arranged next to each other in the longitudinal direction of the conveyor belt. The supporting rollers can in particular rotate at the same speed as the supported conveyor belt is moving, with the result that as little friction as possible arises between the supporting rollers and the conveyor belt. This means that the supporting rollers have the same speed at their circumference as the supported conveyor belt.

The supporting device can alternatively or additionally have an in particular fixed support body, preferably in the form of a plate.

The conveyor belt can have a thickness in the range of from 0.2 mm to 1 mm, preferably in the range of from 0.3 mm to 0.5 mm.

It can be provided that the conveyor belt is formed from a material which has a degree of hardness in the range of from 450 HV10 to 520 HV10, preferably in the range of from 465 HV10 to 500 HV10.

In an advantageous embodiment, it can be provided that the conveyor belt is formed and/or mounted such that its maximum deflection under normal operating load lies in the range of from 1 μm to 10 μm.

Further it can be provided that the surface of the conveyor belt facing the substrate is polished, i.e. has a surface roughness of less than 0.3 μm.

The conveyor belt can be formed from a steel alloy.

In an advantageous embodiment, it can be provided that the conveyor belt is formed from stainless steel.

Alternatively, it can be provided that the conveyor belt is formed from copper or aluminum or titanium or from an alloy which contains copper and/or aluminum and/or titanium, in particular from an alloy which contains aluminum and/or titanium.

The conveyor belt can be formed as a seamless belt. A seamless conveyor belt without joints provides the same conditions over its whole surface with respect to the property as mechanical counter surface for the substrate.

The conveyor belt can have several partial conveyor belts which are arranged connected to each other in the transport direction, preferably with the smallest possible distance between the partial conveyor belts. These partial conveyor belts can have the same or also different properties, in particular with respect to material and/or hardness and/or thickness and/or bending stiffness. The properties described above for the conveyor belt also apply to the partial conveyor belts.

For example, a first partial conveyor belt can be arranged in the area of the coating device and a second partial conveyor belt can be arranged in the area of the corona device.

In an advantageous embodiment, it can be provided that, between adjacent partial conveyor belts, a supporting element is arranged which bridges the distance between the adjacent partial conveyor belts without leaving a gap.

Alternatively, it can be provided that the conveyor belt is formed as a link conveyor composed of plate-type links, wherein adjacent links are connected to each other by a pivot joint such that they form a gap-free supporting surface in the extended state.

It can be provided that the conveyor belt has transport recesses at the edge, and that the guide rollers have corresponding toothed rims which engage in the transport recesses.

Further it can be provided that the conveyor belt has through-holes, in particular a plurality of through-holes.

The through-holes can be formed as in particular circular drilled holes and/or in particular elliptical elongated holes and/or slits and/or rhombuses.

Further it can be provided that the through-holes are arranged in a grid.

The grid can be formed regular or irregular or random.

It can also be provided that the grid is formed differently in areas.

The through-holes can have a diameter in the range of from 0.2 mm to 5 mm, preferably in a range of from 0.3 mm to 2 mm or can have a surface area corresponding to a circular hole of above-named diameter, in particular when the through-hole is not formed circular.

It can be provided that a sealing element with a circumferential sealing lip is arranged between the side of the conveyor belt facing away from the substrate and a suction head of the vacuum suction device.

In an advantageous embodiment, it can be provided that the vacuum of the vacuum suction device lies in the range of from 0.1 bar to 1 bar, in particular in the range of from 0.1 bar to 0.75 bar.

It can be provided that the corona device has a housing that is open on its underside, in the lower end portion of which an electrode is arranged. The electrode can be formed, for example, as an air-cooled ceramic electrode, and can have a cross-section of 16 mm×16 mm and a length which corresponds to the width of the conveyor belt. The corona device can be arranged with its longitudinal side transverse to the transport direction of the conveyor belt and above the substrate.

It can be provided that the electrode of the corona device forms the cathode and the conveyor belt as counter electrode forms the anode of the corona device, wherein a corona gap is formed between the cathode and the anode. The corona gap can lie, for example, in the range of from 1 mm to 2 mm.

A high electrical voltage is applied to the electrode and the counter electrode, which is generated by a high-frequency generator with a frequency range of from 10 kHz to 60 kHz and develops a field strength of from 20 kV/cm to 30 kV/cm in the air gap. Ions are formed by field ionization and are accelerated in the electric field and attach themselves to the surface of the substrate.

The polar fraction of the surface tension of the substrate can be increased through the formation of polar functional groups. The surface of the substrate is electrically charged; the surface energy of the substrate is increased. For good wetting of the substrate with a liquid, thus e.g. a UV adhesive or a printing ink, the surface tension of the substrate should be approx. 10 mN/m to 15 mN/m higher than the surface tension of the liquid. For example, the surface tension of an ink can be between 20 mN/m and 25 mN/m and the surface tension of a film-type substrate to be printed on can be between 30 mN/m and 35 mN/m. The surface tension of the substrate can be increased to approx. 40 mN/m to 45 mN/m by means of the corona device, whereby this substrate can be printed on.

The corona gap can be formed adjustable. For example, the electrode of the corona device can be formed height-adjustable. A corona gap which is as small as possible can thereby be adjustable, for example depending on the thickness and/or on the material of the substrate, in order to be able to adapt the electric field surrounding and/or penetrating the substrate.

The corona device can have an extraction device for the removal of ozone by suction, connected in a gas-tight manner to the housing. Ozone, which must be removed by suction or destroyed, is generated by the ionization of the air in the corona gap. The ozone-containing extracted air is conducted via an extracted-air tube and discharged outside the production space. The ozone-containing extracted air can optionally be guided through an ozone destroyer, for example an activated carbon filter, before being discharged into the environment. In this way 99.5% of the ozone can be destroyed. The extracted-air tube can have, for example, a length of from 12 m to 15 m. An extraction rate of 4.9 $m^3$/min has proven successful. The extraction device can at the same time form a cooling device for the electrode.

It can be provided that the coating device is formed as a printing device. The printing device can have, for example, a printing roller and an inking device and/or can operate according to the screen printing principle and/or according to the inkjet principle.

It can also be provided that the coating device has a stamping device for transferring a transfer layer arranged on a carrier layer of a transfer film, in particular a hot-stamping film or cold-stamping film, onto the substrate.

A stamping roller of the stamping device can have on its outer circumference a coating of an elastomer with a thickness in the range of from 3 mm to 10 mm, preferably in the range of from 5 mm to 10 mm. The elastomer is preferably silicone rubber. The silicone rubber preferably has a hardness in the range of from 60° Shore A to 95° Shore A, preferably in the range of from 70° Shore A to 90° Shore A. A supporting roller arranged in the area of the stamping device forms an impression cylinder for the stamping roller.

The coating device can preferably be arranged downstream, after the corona device. The coating of the substrate can thereby be effected after the treatment of the substrate surface by means of the corona device.

Downstream, after the corona device, several coating stations can also be arranged downstream one after another, for example several printing devices and/or several stamping device and/or a printing device and a stamping device or other combinations thereof. The printing devices can each operate according to the same printing method and/or according to different printing methods. The stamping devices can each operate according to the same method and/or according to different methods.

Downstream, after the corona device and preferably after the at least one coating device, it is also possible to arrange further processing stations such as sorting stations, punching stations, blind-embossing stations, folding stations or other processing stations for the processing of the substrate.

The transfer film has a transfer layer arranged on a carrier layer. The carrier layer can be made of e.g. PET or polypropylene, polystyrene, PVC, PMMA, ABS, polyamide. The hot-stamping film is arranged such that the transfer layer is facing the upper side of the substrate to be stamped. The transfer layer can be coated with a heat-activatable adhesive layer or can be formed self-adhesive (cold adhesive). A separating layer which facilitates the detachment of the transfer layer from the carrier layer can be arranged between the transfer layer and the carrier layer.

In general, the transfer layer of the transfer film has several layers, in particular a detachment layer (for example made of wax or wax-containing compounds), a protective varnish layer, a heat-activatable adhesive layer. One or more decoration layers and/or functional layers, applied over part of the surface or over the whole surface, can additionally be included. Decoration layers are, for example, colored (opaque or transparent or translucent) varnish layers, metal layers or relief structures (with a haptic or optically refractive or optically diffractive effect). Functional layers are, for example, electrically conductive layers (metal, ITO (ITO=indium tin oxide)), electrically semiconductive layers (e.g. semiconductor polymers) or electrically non-conductive layers (electrically insulating varnish layers) or optically matting or anti-reflective layers (e.g. with microscopic matte structures) or structures that modify the adhesive action and/or the surface tension (lotus effect structures or similar). Additional auxiliary layers, in particular adhesion promoter layers, can be present between the individual layers. The individual layers of the transfer ply are approximately between 1 nm and 50 μm thick.

The substrate is preferably a flexible substrate, for example paper with a weight per unit area of from 30 g/$m^2$ to 350 g/$m^2$, preferably 80 g/$m^2$ to 350 g/$m^2$, or cardboard or plastic or a hybrid material made of several paper and plastic layers or a laminate made of several paper and/or plastic layers.

BRIEF DESCRIPTION OF THE DRAWINGS

The invention is now explained in more detail with reference to embodiment examples. There are shown in.

DETAILED DESCRIPTION OF THE PREFERRED EMBODIMENTS

Figure 1:
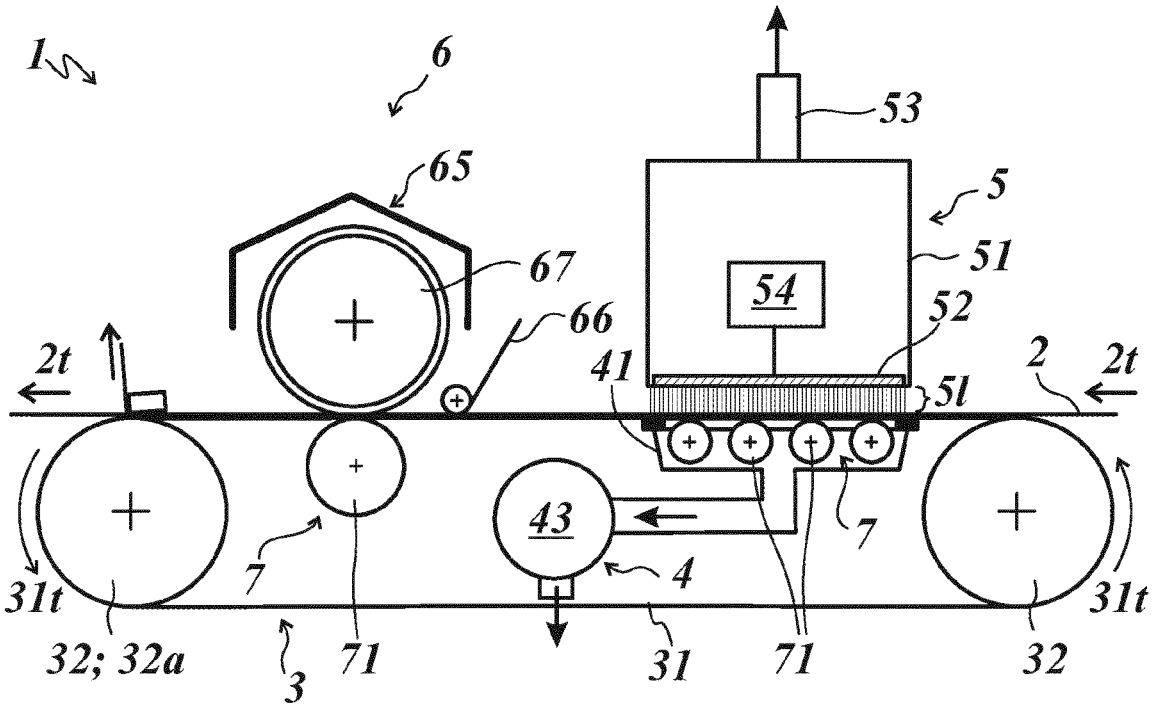
FIG. 1 a first embodiment example of the device according to the invention in a schematic representation.

FIG. 1 shows a device 1 for the surface coating of a substrate 2, comprising a transport device 3, a vacuum suction device 4, a corona device 5 and a coating device 6.

The transport device 3 is formed as a rotating conveyor belt 31, which is mounted on two guide rollers 32 spaced apart from each other, wherein one of the guide rollers 32 is formed as a drive roller 32*a*. The conveyor belt 31 is formed as a seamless belt made of stainless steel in the embodiment shown in FIG. 1.

It can also be provided that the conveyor belt 31 is formed as a link conveyor composed of plate-type links, wherein adjacent links are connected to each other by a pivot joint such that they form a gap-free supporting surface in the extended state. In this embodiment, not represented in the figures, the conveyor belt 31 can advantageously have transport recesses at the edge which interact with corresponding toothed rims, which are connected to the guide rollers 32 in a torsionally rigid manner.

The conveyor belt 31 rotates in a transport direction 31*t*. The substrate 2 is arranged on the conveyor belt 31 in a transport section of the conveyor belt 31 and is fixed on the conveyor belt 31 by a vacuum. The substrate 2 is moved, corresponding to the transport direction 31*t* of the conveyor belt 31, in a transport direction 2*t* which corresponds to the transport direction 31 in the transport section.

The conveyor belt 31 is mounted on a supporting device 7 in the area of the corona device 5 and in the area of the coating device 6. The coating device 6 is arranged downstream, after the corona device 5.

In the embodiment example represented in FIG. 1, the supporting device 7 arranged underneath the corona device 5 is formed from four supporting rollers 71, which are arranged next to each other in the longitudinal direction of the conveyor belt 31. The supporting rollers 71 can in particular rotate at the same speed as the supported conveyor belt 31 is moving, with the result that as little friction as possible arises between the supporting rollers 71 and the conveyor belt 31. This means that the supporting rollers 71 have the same speed at their circumference as the supported conveyor belt 31. The four supporting rollers 71 are rigid or are mounted adjustably rotatable. The axes of rotation of the supporting rollers 71 can be fixed adjustably at their external bearing position such that, for example, an adjustment by means of an eccentric bearing and corresponding fixing of the bearing an adjustment of the axes of rotation relative to the conveyor belt 31 is possible. The axes of rotation of the supporting rollers 71 are aligned transverse to the transport direction 31*t* of the conveyor belt 31. As an alternative or in addition to the supporting rollers 71, a plate-type support can also be provided, in particular as a fixed support body.

The supporting device 7 arranged underneath the coating device 6 has a supporting roller 71, the axis of rotation of which is likewise aligned transverse to the transport direction 31*t* of the conveyor belt 31.

In the embodiment example represented in FIG. 1, the maximum deflection of the conveyor belt 31 under normal operating load lies in the range of from 1 μm to 10 μm. Through such a low deflection the conveyor belt can particularly advantageously act as a mechanical counter surface for the substrate.

The conveyor belt 31 has a thickness in the range of from 0.2 mm to 1 mm, preferably in the range of from 0.3 mm to 0.5 mm.

The conveyor belt 31 is formed from a material which has a degree of hardness in the range of from 450 HV10 to 520 HV10, preferably in the range of from 465 HV10 to 500 HV10.

The conveyor belt 31 can be formed from a steel alloy, preferably from stainless steel. It can also be provided the conveyor belt is formed from copper, aluminum or titanium.

The surface of the conveyor belt facing the substrate 2 is polished, i.e. it has a surface roughness of less than 0.3 μm.

The conveyor belt 31 is formed as a vacuum suction belt 31*v* with through-holes 31*d* (see FIGS. 4 to 8), via which a vacuum can be formed on the upper side of the conveyor belt 31, which fixes the substrate 2 on the conveyor belt 31. In the embodiment example represented in FIG. 1, the vacuum lies in the range of from 0.1 bar to 1 bar.

The through-holes 31 can be formed as in particular circular drilled holes and/or in particular elliptical elongated holes and/or slits and/or rhombuses.

Via a sealing element 42 arranged on the side of the conveyor belt 31 facing away from the substrate 2, a section of the conveyor belt 31 arranged above the sealing element 42 is connected to a suction head 41 of the vacuum suction device 4 in a gas-tight or almost gas-tight manner. The sealing element 42 is formed as a circumferential sealing lip. In the embodiment example represented in FIG. 1, a suction head 41 is provided, wherein the suction head 41 is arranged underneath the corona device 5. The vacuum suction device 4 is formed with a vacuum pump 43, the inlet of which is connected to the suction head 41.

Figure 4:
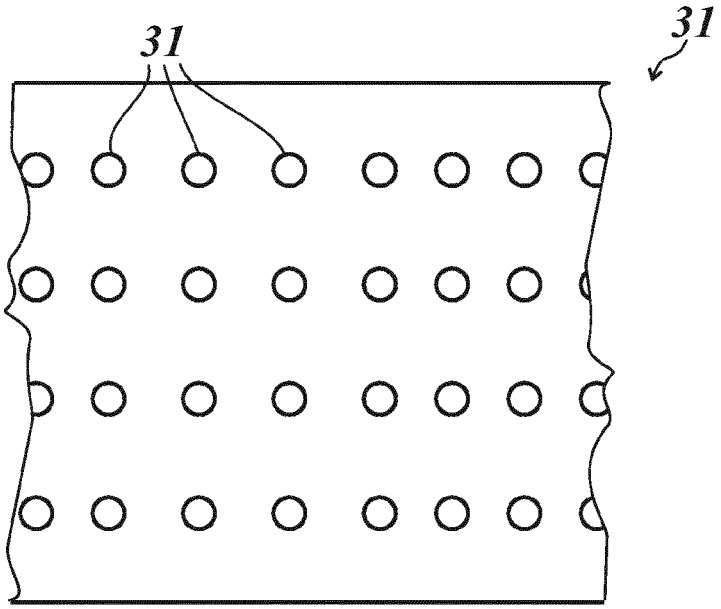
FIG. 4 a first embodiment example of a conveyor belt in FIG. 1 in a schematic top view.
Figure 8:
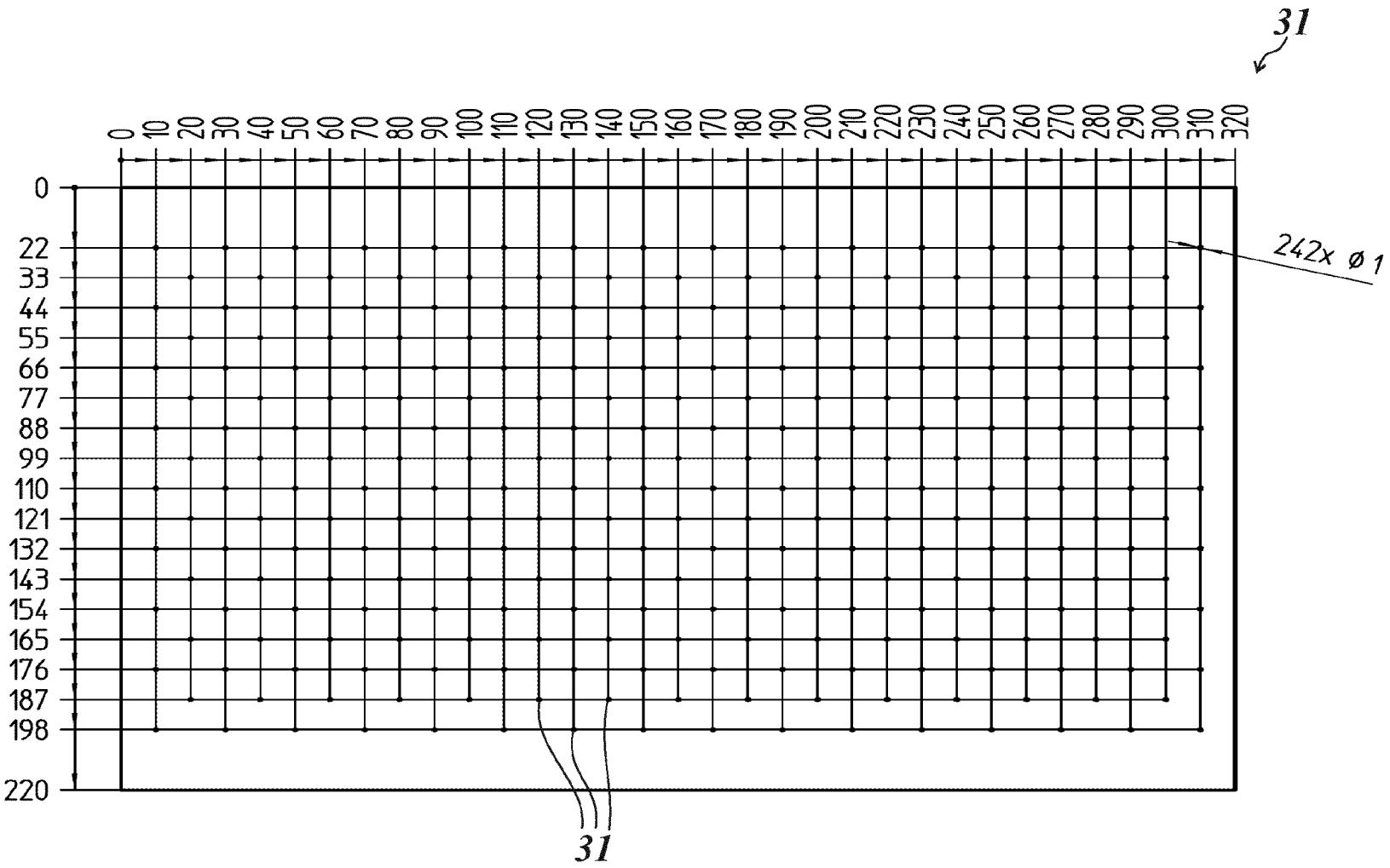
FIG. 8 a fourth embodiment example of the conveyor belt in FIG. 1 in the top view.

FIGS. 4 and 8 show a first embodiment example of the vacuum suction belt 31*v*. Through-holes 31*d* formed as drilled holes with a circular cross-section are arranged in a grid. The through-holes 31*d* can have a diameter in the range of from 0.2 mm to 5 mm, preferably in a range of from 0.3 mm to 2 mm or can have a surface area corresponding to a circular hole of above-named diameter.

Figure 7:
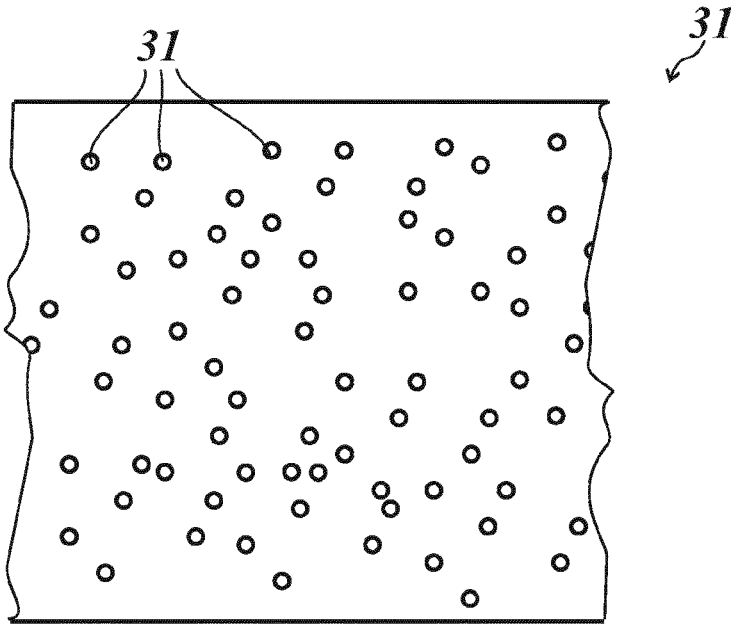
FIG. 7 a fourth embodiment example of the conveyor belt in FIG. 1 in a schematic top view.

In the embodiment example represented in FIG. 7, the through-holes 31*d* have a diameter of 1 mm.

Figure 5:
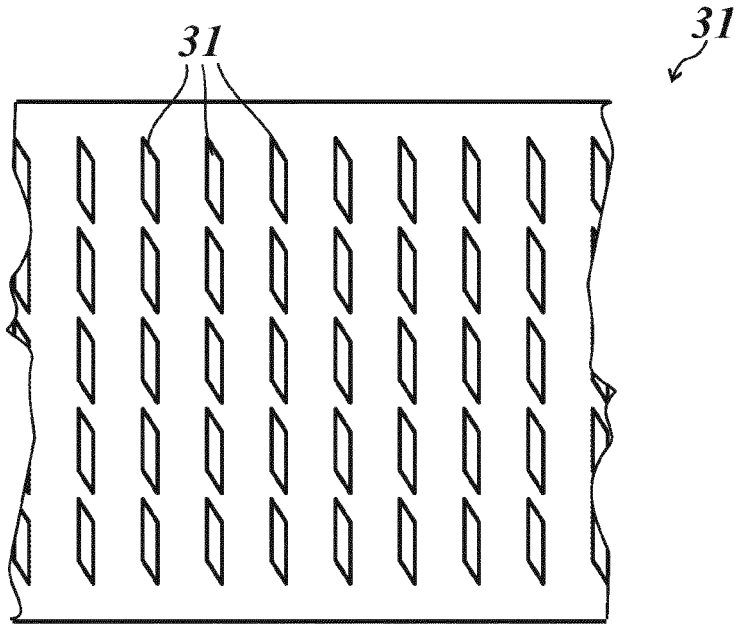
FIG. 5 a second embodiment example of the conveyor belt in FIG. 1 in a schematic top view.

FIG. 5 shows a second embodiment example in which the through-holes 31*d* are formed as rhombic elongated holes which are arranged in a grid.

Figure 6:
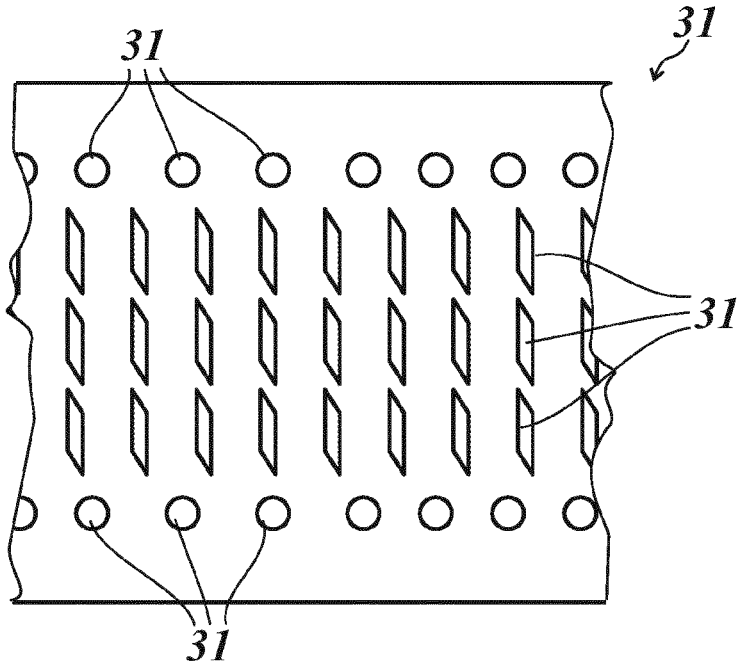
FIG. 6 a third embodiment example of the conveyor belt in FIG. 1 in a schematic top view.

FIG. 6 shows a third embodiment example in which the through-holes 31 are formed with a different contour in areas. In a central area the through-holes 31*d* are formed rhombic. In the two edge areas the through-holes 31 are formed with a circular cross-section. The grid is also formed differently in areas.

FIG. 6 shows a fourth embodiment example in which the through-holes 31*d* are arranged randomly distributed.

As the embodiment examples described above show, the grid can be formed regular or irregular or random.

The corona device 5 has a housing 51 that is open on the underside, in which an electrode 52 is arranged. The electrode 52 is formed as an air-cooled ceramic electrode and arranged above the substrate 2. The conveyor belt 31 forms a counter electrode 31*e*, which is in particular earthed. In the embodiment example represented in FIG. 1, the electrode 52 has a cross-section of 16 mm×16 mm and a length which corresponds to the width of the conveyor belt 31 (here: 350 mm). Here, the corona device 5 can be arranged with its longitudinal side transverse to the transport direction 31*t* of the conveyor belt 31. The electrode 52 is connected as cathode. The counter electrode 31*e* is connected as anode. Between the electrode 52 and the counter electrode 31*e* a corona gap 5*l* is formed, between which the corona discharge is generated. The corona gap 5*l* is adjustable, in particular height-adjustable, and in the embodiment example represented in FIG. 1 is 1 mm to 2 mm. A corona gap 5I which is as small as possible can thereby be adjustable, for example depending on the thickness and/or on the material of the substrate 2, in order to be able to adapt the electric field surrounding and/or penetrating the substrate 2.

A high electrical voltage is applied to the electrode 52 and the counter electrode 31*e*, which is generated by a high-frequency generator 54 with a frequency range of from 10 kHz to 60 kHz and develops a field strength of from 20 kV/cm to 30 kV/cm in the air gap 5*l*. Ions are formed by field ionization and are accelerated in the electric field and attach themselves to the surface of the substrate 2.

The polar fraction of the surface tension of the substrate 2 can be increased through the formation of polar functional groups. The surface of the substrate 2 is electrically charged; the surface energy of the substrate 2 is increased. For good wetting of the substrate 2 with a liquid, thus e.g. a UV adhesive or a printing ink, the surface tension of the substrate 2 should be approx. 10 mN/m to 15 mN/m higher than the surface tension of the liquid. For example, the surface tension of an ink can be between 20 mN/m and 25 mN/m and the surface tension of a film-type substrate 2 to be printed on can be between 30 mN/m and 35 mN/m. The surface tension of the substrate 2 can be increased to approx. 40 mN/m to 45 mN/m by means of the corona device 5, whereby this substrate 2 can be printed on.

The corona device 5 has an extraction device 53 for the removal of ozone by suction, connected in a gas-tight manner to the housing 51. Ozone, which must be removed by suction or destroyed, is generated by the ionization of the air in the air gap 5*l*. The ozone-containing extracted air is conducted via an extracted-air tube and discharged outside the production space. The ozone-containing extracted air can optionally be guided through an ozone destroyer, for example an activated carbon filter, before being discharged into the environment. In this way 99.5% of the ozone can be destroyed. The extracted-air tube can have, for example, a length of from 12 to 15 m. An extraction rate of 4.9 $m^3$/min has proven successful. The extraction device 53 at the same time forms a cooling device for the electrode 52.

The coating device 6 is formed as a stamping device 65 for transferring a transfer layer arranged on a carrier layer of a transfer film 66, in particular a hot-stamping film or cold-stamping film, onto the substrate 2.

A stamping roller 67 of the stamping device 65 has on its outer circumference a coating of an elastomer with a thickness in the range of from 3 mm to 10 mm, preferably in the range of from 5 mm to 10 mm. The elastomer is preferably silicone rubber. In the embodiment example represented in FIG. 1, the silicone rubber has a hardness of 80° Shore A. The supporting roller 71 arranged in the area of the stamping device 65 forms an impression cylinder for the stamping roller 67.

Figure 2:
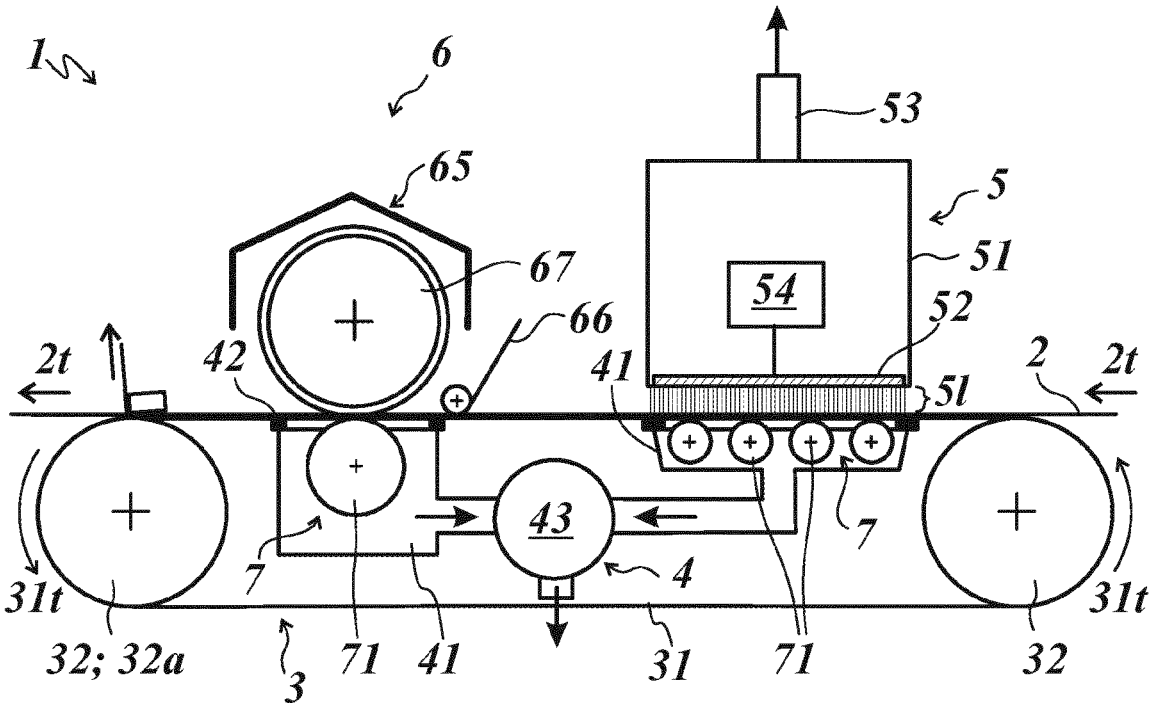
FIG. 2 a second embodiment example of the device according to the invention in a schematic representation.

In the embodiment example represented in FIG. 2, in contrast to FIG. 1 two suction heads 41 are provided, wherein one suction head 41 is arranged underneath the corona device 5 and the other suction head 41 is arranged underneath the coating device 6. The vacuum suction device 4 is formed with a vacuum pump 43, the inlets of which are connected to the two suction heads 41.

Figure 3:
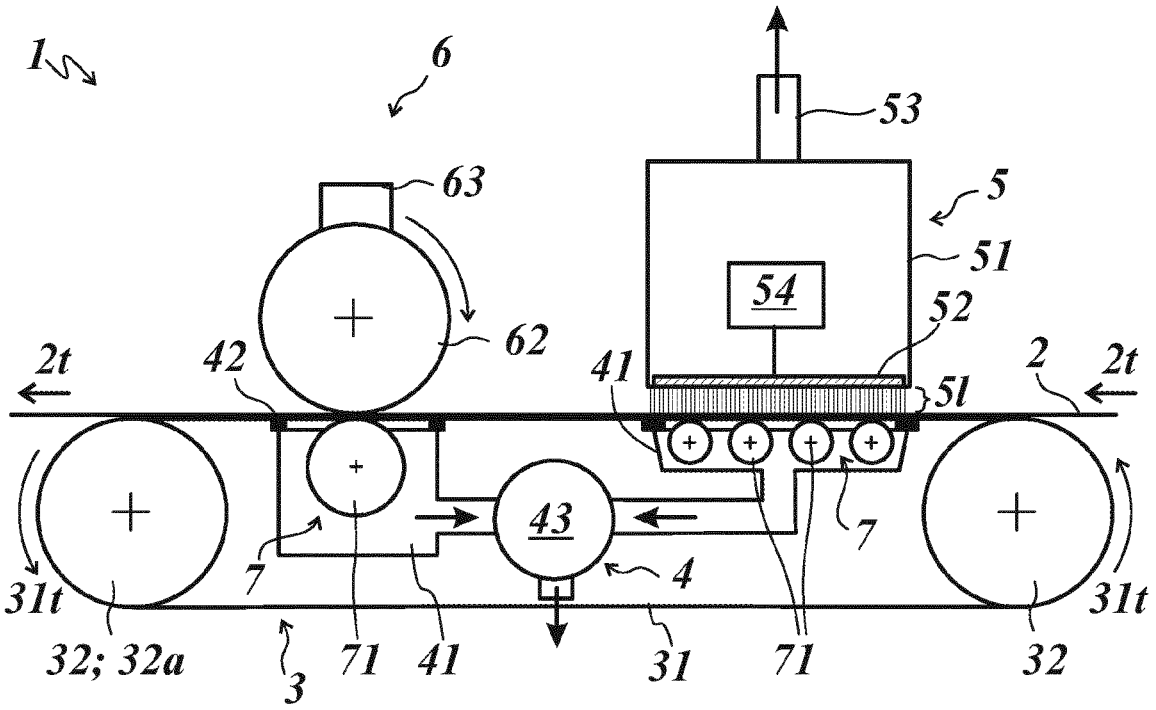
FIG. 3 a third embodiment example of the device according to the invention in a schematic representation.

The device 1 represented in FIG. 3 is formed like the device represented in FIG. 2, with the difference that the coating device 6 is formed as a printing device 61 comprising a printing roller 62 and an inking device 63. Other printing devices can also be provided, for example a printing device according to the screen printing principle and/or according to the inkjet principle.

LIST OF REFERENCE NUMBERS

1 device
2 substrate
2*t* transport direction
3 transport device
3*t* transport direction
4 vacuum suction device
5 corona device
5*l* air gap
6 coating device
7 supporting device
31 conveyor belt
31*d* through-hole
31*e* counter electrode
31*t* transport direction
31*v* vacuum suction belt
32 guide rollers
32*a* drive roller
41 suction head
42 sealing element
43 vacuum pump
51 housing
52 electrode
53 extraction device
54 high-frequency generator
61 printing device
62 printing roller
62 inking device
65 stamping device
66 transfer film
67 stamping roller
71 supporting roller

The invention claimed is:

1. A device for the surface treatment of a substrate, having a transport device, a vacuum suction device, a corona device, and a coating device, wherein the transport device has a conveyor belt, and wherein the conveyor belt is formed as a vacuum suction belt of the vacuum suction device, and wherein the conveyor belt is formed as a counter electrode of the corona device, and wherein the corona device has a housing that is open on its underside, in the lower end portion of which the electrode of the corona device is arranged, and wherein the electrode of the corona device forms a cathode and the conveyor belt formed as the counter electrode forms an anode of the corona device and a corona gap is formed between the cathode and the anode, and wherein the electrode of the corona device is formed as an air-cooled ceramic electrode and is arranged above the substrate, and wherein a sealing element with a circumferential sealing lip is arranged between the side of the conveyor belt facing away from the substrate and a suction head of the vacuum suction device, and wherein the suction head is arranged underneath the corona device, and wherein the conveyor belt has through-holes, and wherein the coating device is disposed downstream of the corona device, and wherein the coating device is formed as one of a printing device or a stamping device for transferring a transfer layer arranged on a carrier layer of a transfer film onto the substrate.

2. The device according to claim 1, wherein the conveyor belt is mounted on two guide rollers spaced apart from each other, wherein one of the guide rollers is formed as a drive roller.

3. The device according to claim 1, wherein the conveyor belt is formed as a rotating belt.

4. The device according to claim 1, wherein the conveyor belt is mounted on a supporting device in the area of the corona device and/or of the coating device.

5. The device according to claim 4, wherein the supporting device has one supporting roller or several supporting rollers, which are arranged next to each other in the longitudinal direction of the conveyor belt.

6. The device according to claim 1, wherein the conveyor belt has a thickness in the range of from 0.2 mm to 1 mm.

7. The device according to claim 1, wherein the conveyor belt is formed from a material which has a degree of hardness in the range of from 450 HV10 to 520 HV10.

8. The device according to claim 1, wherein the conveyor belt is formed and/or mounted such that its maximum deflection under normal operating load lies in the range of from 1 μm to 10 μm.

9. The device according to claim 1, wherein the surface of the conveyor belt facing the substrate has a surface roughness of less than 0.3 μm.

10. The device according to claim 1, wherein the conveyor belt is formed from a steel alloy.

11. The device according to claim 10, wherein the conveyor belt is formed from stainless steel.

12. The device according to claim 1, wherein the conveyor belt is formed from copper or aluminum or titanium or from an alloy which contains copper and/or aluminum and/or titanium.

13. The device according to claim 1, wherein the conveyor belt is formed as a seamless belt.

14. The device according to claim 1, wherein the conveyor belt has several partial conveyor belts which are arranged connected to each other in the transport direction.

15. The device according to claim 14, wherein, between adjacent partial conveyor belts, a supporting element is arranged which bridges the distance between the adjacent partial conveyor belts without leaving a gap.

16. The device according to claim 1, wherein the conveyor belt is formed as a link conveyor composed of plate-type links, wherein adjacent links are connected to each other by a pivot joint such that they form a gap-free supporting surface in the extended state.

17. The device according to claim 16, wherein the conveyor belt has transport recesses at the edge, and wherein the guide rollers have corresponding toothed rims which engage in the transport recesses.

18. A device for the surface treatment of a substrate, having a transport device, a vacuum suction device, a corona device, and a coating device, wherein the transport device has a conveyor belt, and wherein the conveyor belt is formed as a vacuum suction belt of the vacuum suction device, and wherein the conveyor belt is formed as a counter electrode of an electrode the corona device, and wherein the corona device has a housing that is open on its underside, in which the electrode of the corona device is arranged, wherein the electrode of the corona device is formed as an air-cooled ceramic electrode and is arranged above the substrate, and wherein the corona device further comprises an extraction device for the removal of ozone by suction, the extraction device being connected in a gas-tight manner to the housing of the corona device, and wherein the extraction device at the same time forms a cooling device for the electrode, and wherein a coating device is disposed downstream of the corona device, and wherein the coating device is formed as one of a printing device or a stamping device for transferring a transfer layer arranged on a carrier layer of a transfer film onto the substrate.

19. The device according to claim 1, wherein the through-holes are formed as drilled holes and/or elongated holes and/or slits and/or rhombuses.

20. The device according to claim 1, wherein the through-holes are arranged in a grid.

21. The device according to claim 20, wherein the grid is formed regular or irregular or random.

22. The device according to claim 20, wherein the grid is formed differently in areas.

23. The device according to claim 1, wherein the through-holes have a diameter in the range of from 0.2 mm to 5 mm, or have a surface area corresponding to a circular hole of above-named diameter.

24. The device according to claim 18, wherein a sealing element with a circumferential sealing lip is arranged between the side of the conveyor belt facing away from the substrate and a suction head of the vacuum suction device.

25. The device according to claim 1, wherein the vacuum of the vacuum suction device lies in the range of from 0.1 bar to 1 bar.

26. The device according to claim 18, wherein the electrode of the corona device forms the cathode and the conveyor belt as counter electrode forms the anode of the corona device, wherein a corona gap is formed between the cathode and the anode.

27. The device according to claim 1, wherein the corona gap is formed adjustable.

28. A device for the surface treatment of a substrate, having a transport device, a vacuum suction device, a corona device, and a coating device, wherein the transport device has a conveyor belt, and wherein the conveyor belt is formed as a vacuum suction belt of the vacuum suction device, and wherein the conveyor belt is formed as a counter electrode of an electrode the corona device, and wherein the corona device has a housing that is open on its underside, in the lower end portion of which the electrode of the corona device is arranged, and wherein the electrode of the corona device forms a cathode and the conveyor belt formed as the counter electrode forms an anode of the corona device and a corona gap is formed between the cathode and the anode, and wherein a sealing element with a circumferential sealing lip is arranged between the side of the conveyor belt facing away from the substrate and a suction head of the vacuum suction device, and wherein the suction head is arranged underneath the corona device, and wherein the conveyor belt has through-holes, and wherein the coating device is disposed downstream of the corona device, and wherein the coating device is formed as one of a printing device or a stamping device for transferring a transfer layer arranged on a carrier layer of a transfer film onto the substrate.

29. The device according to claim 18, wherein the conveyor belt has through-holes.

30. The device according to claim 1, wherein the corona device further comprises an extraction device for the removal of ozone by suction, the extraction device being connected in a gas-tight manner to the housing of the corona device, and wherein the extraction device at the same time forms a cooling device for the electrode.

* * * * *